US009140251B2

(12) United States Patent
Beiriger

(10) Patent No.: US 9,140,251 B2
(45) Date of Patent: Sep. 22, 2015

(54) PERISTALTIC PUMP ARRANGEMENT AND PUMP ROLLERS

(75) Inventor: Michael J. Beiriger, Pittsburgh, PA (US)

(73) Assignee: Fresenius Medical Care Holdings, Inc., Waltham, MA (US)

( * ) Notice: Subject to any disclaimer, the term of this patent is extended or adjusted under 35 U.S.C. 154(b) by 654 days.

(21) Appl. No.: 12/987,670

(22) Filed: Jan. 10, 2011

(65) Prior Publication Data

US 2012/0175292 A1 Jul. 12, 2012

(51) Int. Cl.
*F04B 43/12* (2006.01)

(52) U.S. Cl.
CPC ..... *F04B 43/1276* (2013.01)

(58) Field of Classification Search
CPC .. F04B 43/12; F04B 43/1223; F04B 43/1238; F04B 43/1246; F04B 43/1253; F04B 43/1269
USPC ..... 417/477.2, 477.3, 477.8, 474, 477.9, 417/477.12
See application file for complete search history.

(56) References Cited

U.S. PATENT DOCUMENTS

| | | | | | |
|---|---|---|---|---|---|
| 2,314,281 | A | * | 3/1943 | Knott | 417/477.7 |
| 2,693,766 | A | * | 11/1954 | Seyler | 417/477.7 |
| 2,804,023 | A | * | 8/1957 | Lee | 417/477.7 |
| 3,644,068 | A | * | 2/1972 | Lepak | 417/477.7 |
| 3,737,256 | A | * | 6/1973 | De Vries | 417/477.7 |
| 3,737,257 | A | * | 6/1973 | DeVries | 417/477.8 |
| 3,822,948 | A | | 7/1974 | Handl | |
| 4,142,845 | A | * | 3/1979 | Lepp et al. | 417/477.8 |
| 4,155,362 | A | | 5/1979 | Jess | |
| 4,278,085 | A | | 7/1981 | Shim | |
| 4,288,205 | A | * | 9/1981 | Henk | 417/477.3 |
| 4,705,464 | A | | 11/1987 | Arimond | |
| 4,950,136 | A | * | 8/1990 | Haas et al. | 417/477.7 |
| 5,110,270 | A | | 5/1992 | Morrick | |
| 5,215,450 | A | | 6/1993 | Tamari | |
| 5,263,831 | A | * | 11/1993 | Kappus | 417/477.7 |
| 5,342,181 | A | * | 8/1994 | Schock et al. | 417/476 |
| 5,741,125 | A | | 4/1998 | Neftel et al. | |
| 6,036,459 | A | * | 3/2000 | Robinson | 417/477.7 |
| 6,082,977 | A | * | 7/2000 | Nishioka | 417/476 |
| 6,494,693 | B1 | | 12/2002 | Sunden | |
| 6,626,867 | B1 | | 9/2003 | Christenson et al. | |
| 6,733,476 | B2 | | 5/2004 | Christenson et al. | |
| 6,736,617 | B2 | * | 5/2004 | Domroese | 417/477.7 |
| 8,147,223 | B2 | * | 4/2012 | Harada et al. | 417/477.11 |
| 2002/0173755 | A1 | * | 11/2002 | Christenson et al. | 604/288.04 |
| 2010/0129247 | A1 | * | 5/2010 | Lauer | 417/477.8 |
| 2010/0129248 | A1 | * | 5/2010 | Mou | 417/477.9 |

* cited by examiner

*Primary Examiner* — Charles Freay
*Assistant Examiner* — Lilya Pekarskaya
(74) *Attorney, Agent, or Firm* — Leydig, Voit & Mayer, Ltd.

(57) ABSTRACT

A peristaltic pump for use with tubing. The pump includes a raceway and a rotatably mounted rotor that form a passageway therebetween for the tubing. A plurality of roller assemblies is pivotably and eccentrically mounted to the rotor. Each roller assembly has a length, and includes a roller having an outer surface disposed to selectively roll along said tubing when received in the passageway. At least one compliance mechanism is coupled to and contained substantially within the length of each roller assembly. The compliance mechanism has first and second ends coupled to the rotor and the roller assembly, respectively. The compliance mechanism is adapted and disposed to bias the associated roller assembly outward relative to the rotor, such that a force applied to the roller assembly pivoting the roller assembly inward against the force of the compliance mechanism.

20 Claims, 2 Drawing Sheets

PERISTALTIC PUMP ARRANGEMENT AND PUMP ROLLERS

TECHNICAL FIELD

This patent disclosure relates generally to peristaltic pumps and, more particularly to compliant rollers for a peristaltic pump.

BACKGROUND

Peristaltic pumps are utilized in a variety of applications to feed fluids along a length of compliant or flexible tubing. Peristaltic pumps provide non-contact fluid flow, allowing the use of disposable tubing while maintaining the integrity of the fluid path. Peristaltic pumps are particularly useful in pumping arrangements for corrosive materials or hygienic materials because the pumped material does not come into contact with the mechanical structures defining other parts of the pump.

Peristaltic pumps include compression units, generally in the form of rollers, that compress the tubing against a raceway. Successive rollers capture a "pillow" of fluid within the tubing, pushing the pillow forward as the rollers progress along the tubing.

A variety of arrangements has been utilized for mounting the rollers. For example, some pumps include fixedly mounted rollers, while others include rollers that are outwardly biased, either as a unit, as for example in U.S. Pat. No. 5,110,270 to Morrick, or individually. Those rollers that are individually outwardly biased, may be on pivoting shafts that are sprung individually, as in U.S. Pat. No. 3,644,068 to Lepak, or by way of lever arms, as in as in U.S. Pat. No. 2,314,281 to Knott. Alternately, they may include individually outwardly biased shafts disposed in channels, as in U.S. Pat. No. 4,278,085 to Shim. Pumps with compliant or sprung rollers more easily accommodate various tubing sizes and tubing tolerances. Additionally, compliant rollers can reduce audio output from the pump heads. A common feature of many of the available designs is that, as a result of exposed mechanical elements such as the biasing features, the pumps can be difficult to clean when fluids reach areas outside of the tubing. Further, many present complex designs may be difficult to repair or may limit the number of rollers that may be utilized without a restructuring or redesign of the arrangement.

SUMMARY

This disclosure describes, in one aspect, a biased roller assembly for coupling to a peristaltic pump for use with tubing. The roller assembly has a length and includes a substantially cylindrical roller and a shaft, the roller being rotatably mounted on the shaft to allow the roller to rotate about the shaft. The shaft has an outer annular surface, opposing shaft ends, and a central axis. At least one of the shaft ends includes at least one recess for receiving at least one post element defining a pivot axis. The pivot axis extends substantially parallel to, but not coaxially with, the central axis. The shaft is adapted to be coupled to the pump along the pivot axis. At least one compliance mechanism is contained substantially within the length of the roller assembly. The compliance mechanism has first and second ends, the first end being coupled to at least one of the shaft ends that includes the recess, and the second end being disposed to be coupled to the pump. The compliance mechanism is adapted to bias the shaft when mounted to the pump.

In another aspect, the disclosure describes a peristaltic pump for use with tubing. The pump comprises a raceway and a rotatably mounted rotor that forms a passageway between the raceway and the rotor, the passageway being adapted to receive the tubing. A plurality of roller assemblies is pivotably and eccentrically mounted to the rotor. Each roller assembly has a length, and includes a roller having an outer surface disposed to selectively roll along said tubing when received in the passageway. At least one compliance mechanism is coupled to each roller assembly, and is contained substantially within the length of the roller assembly. The compliance mechanism has first and second ends coupled to the rotor and the roller assembly, respectively. The compliance mechanism is adapted and disposed to bias the associated roller assembly outward relative to the rotor such that a force applied to the roller assembly by the tubing will pivot the roller assembly inward against the force of the compliance mechanism.

According to an additional aspect of the disclosure, there is described a dialysis machine including a peristaltic pump for use with tubing. The pump comprises a raceway and a rotatably mounted rotor that form a passageway adapted to receive the tubing therebetween. A plurality of roller assemblies is pivotably mounted to the rotor. At least one of the roller assemblies has a length, and a substantially cylindrical roller having an outer surface disposed to selectively roll along the tubing when received in the passageway. The roller assembly further includes a shaft, the roller being mounted to rotate about the shaft. The shaft is mounted eccentrically about a pivot axis, which is fixed relative to the shaft and the rotor. At least one compliance mechanism is coupled to the at least one roller assembly and contained substantially within the length of the roller assembly. The compliance mechanism includes at least one torsion spring having first and second ends coupled to the rotor and the roller assembly, respectively. The compliance mechanism is adapted and disposed to bias the associated roller assembly outward relative to the rotor, such that a force applied to the roller assembly by the tubing pivots the roller assembly inward against the force of the compliance mechanism.

BRIEF DESCRIPTION OF THE DRAWING(S)

DETAILED DESCRIPTION

Figure 1:
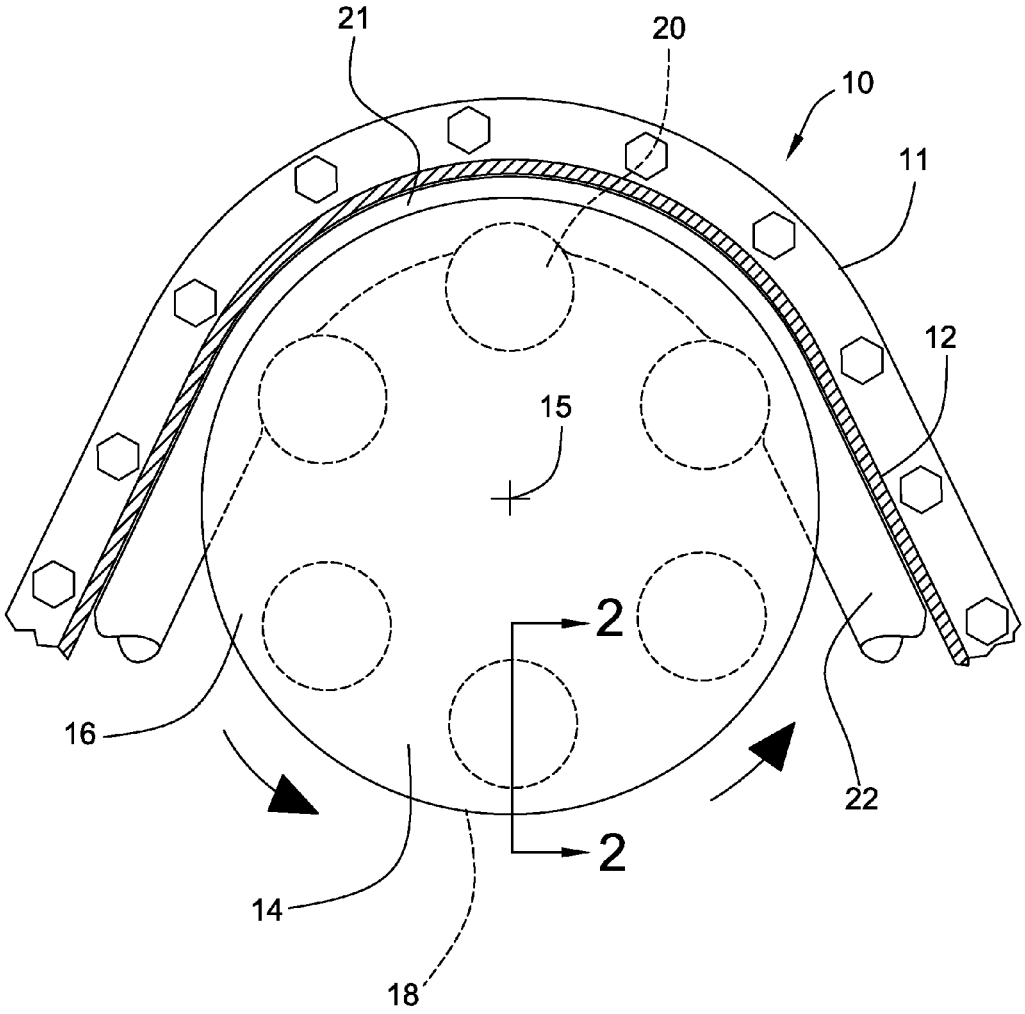
FIG. 1 is a schematic plan view of a rotor with raceway according to this disclosure.

This disclosure relates to an arrangement for a peristaltic pump 10, which may be utilized, for example, in a machine, such as, for example, a dialysis machine. Referring to FIG. 1, there is shown a housing 11 including a raceway 12 and a rotor 14 mounted to rotate about an axis 15. In the illustrated design, the rotor 14 includes a pair of outer plates 16, 18, although the design may be other than as illustrated. A plurality of roller assemblies 20 are rotatably mounted between the outer plates 16, 18. A passageway 21 is formed between the raceway 12 and the rotor 14, and, more specifically, between the raceway 12, the rotor 14, and the roller assemblies 20. Tubing 22 may be disposed between the raceway 12 and the rotor 14 such that the roller assemblies 20 move fluid contained within the tubing 22 through the tubing 22 as the rotor 14 rotates. While any number of roller assemblies 20 may be included, in the illustrated arrangement, six roller assemblies 20 are provided, and the raceway 12 extends along an arc on the order of 120°, ensuring that at least two roller assemblies 20 remain in contact with the tubing 22 at all times.

Figure 3:
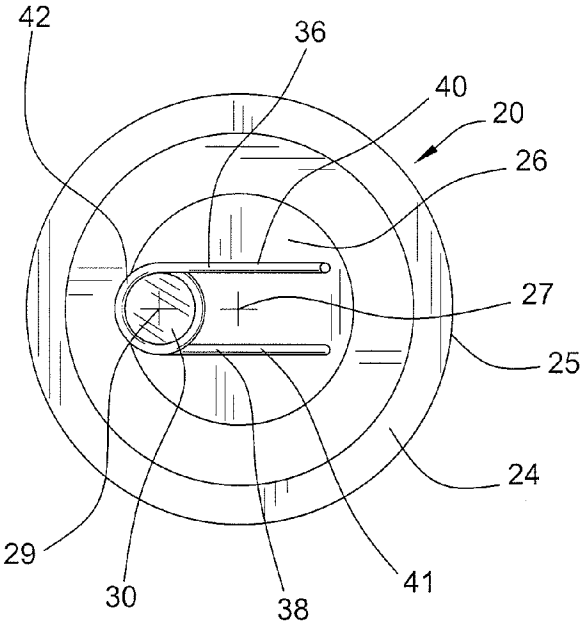
FIG. 3 is an end view of the roller assembly taken along line 3-3 in FIG. 2.
Figure 2:
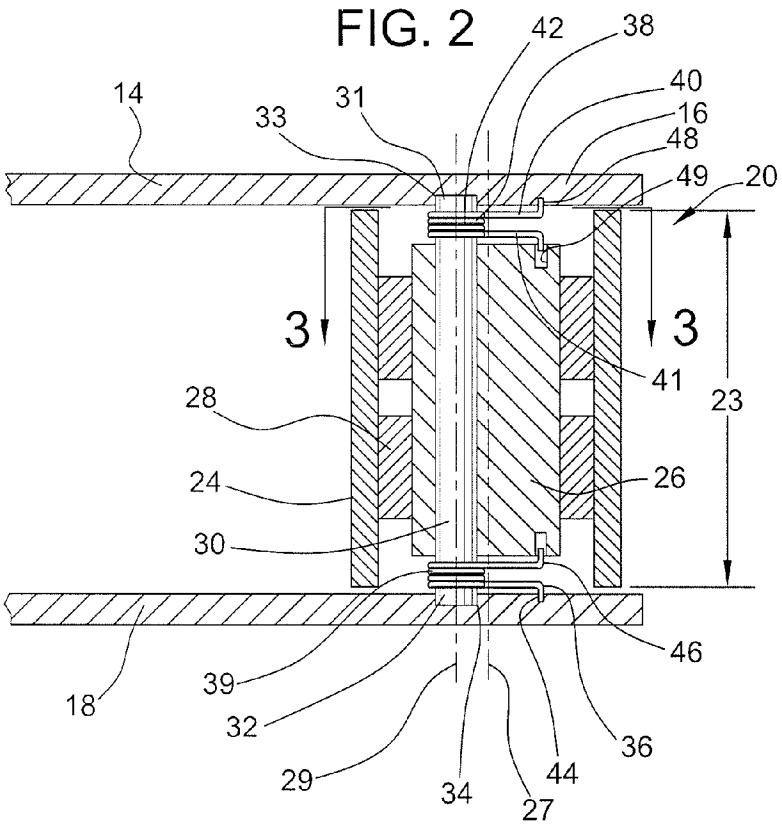
FIG. 2 is a cross sectional view of the rotor and a roller assembly taken along line 2-2 in FIG. 1.

A roller assembly 20 according to the disclosure may be seen more clearly in FIGS. 2 and 3. The illustrated roller assembly 20 has a length 23 and includes a roller 24 that presents a generally cylindrical surface 25. The roller 24 is rotatably mounted to a shaft 26 such that it rotates about a central axis 27 of the shaft 26. The roller 24 may be rotatably mounted to the shaft 26 by any appropriate arrangement, such as, for example, a slip fit. In order to further facilitate the rotation of the roller 24 relative to the shaft 26, however, one or more bearing assemblies 28 may be provided between the shaft 26 and the roller 24. In this way, the generally cylindrically shaped roller 24 may rotate about a central axis 27 the shaft 26 by way of the bearing assemblies 28.

The roller 24, shaft 26 and bearing assemblies 28, if provided, may be of any appropriate material. For example, the roller 24 and shaft 26 may be formed of Delrin® or any other appropriate material. The bearing assemblies 28 may be of any appropriate number and design. For example, in the illustrated roller assembly 20, there are two such rolling contact bearing assemblies 28, although another appropriate number and design may be provided.

The shaft 26 of the roller assembly 20 is eccentrically mounted to pivot on an axis 29, that is, the pivot axis 29 does not coincide with the axis 27 of the shaft 26. In the illustrated embodiment, the pivot axis 29 is defined by a pin 30, which may be formed of any appropriate material, such as, for example, stainless steel. The opposite ends of the pin 30 define post elements 31, 32, that extend from the ends of the shaft 26 and are received in recesses or bores 33, 34 in the outer plates 16, 18 of the rotor 14. It will be appreciated that the shaft 26 may be mounted to pivot about the pin 30, or it may be secured to the pin 30, and the pin 30 pivotably received in the outer plates 16, 18. While the illustrated embodiment includes a pin 30 that extends through the length of the shaft 26 to define the post elements 31, 32, the arrangement could alternately include separate post elements 31, 32 that extend from the ends of the shaft 26 outward to be received in the recesses or bores 33, 34 of the outer plates 16, 18. Alternately, separate post elements 31, 32 could extend inward from the outer plates 16, 18 of the rotor 14 to be received in recesses or bores in the ends of the shaft 26. It will be appreciated that the post elements 31, 32 could be secured to either or neither of the rotor 14 and the shaft 26. Thus, the term post elements 31, 32 is intended to include any protrusions extending along the axis 29 between the rotor 14 and the shaft 26 that permit the shaft 26 to eccentrically rotate about the axis 29 relative to the rotor 14.

In order to bias the roller 24 outward, that is, toward the raceway 12, the roller assemblies 20 are sprung via a compliance mechanism 36 that biases the roller assembly outward relative to the rotor 14, the compliance mechanism 36 asserting a force radially outward from rotor 14 as the tubing 22 applies a force radially inward. In the embodiment illustrated in FIGS. 2 and 3, the compliance mechanism 36 includes a pair of torsion springs 38, 39, although a greater or lesser number of torsion springs 38, 39 may included. The torsion springs 38, 39 each have a pair of arms 40, 41 extending from a central hub 42. In the illustrated embodiment, the hubs 42 of the torsion springs 38, 39 are mounted to the pin 30 that extends between the outer plates 16, 18 of the rotor 14. It will be appreciated, however, that the hub 42 could be alternately disposed.

In order to control the pivotable movement of the roller assembly 20 about the axis 29, the ends 44, 46 of the arms 40, 41 of the torsion springs 38, 39 are coupled to the outer plates 16, 18 of the rotor 14 and the shaft 26 of the roller assembly 20. Here, the ends 44, 46 are disposed within bores 48, 49 in the outer plates 16, 18 and in the shaft 26. In this way, the roller assembly 20 may be outwardly biased such that imposition of a force radially inward toward the rotor 14 may pivot the roller assembly 20 about the axis 29 against the biasing force of the springs 38, 39. While the compliance mechanism 36 of the illustrated embodiment includes a pair of torsion springs, those of skill in the art will appreciate that it could alternatively or additionally utilize compression or tension springs.

According to a feature of an embodiment of the disclosure, the compliance mechanism 36 is substantially contained within the length 23 of the roller assembly 20 itself, as may best be seen in FIG. 2. For the purposes of this disclosure, the term "substantially contained within the length" of the roller assembly does not require that the entirety of the compliance mechanism be contained with the length, only substantially the majority. It will be appreciated, for example, that the ends 44 of the torsions springs 38, 39 extend outside of the length of the roller assembly 20.

This arrangement may protect the compliance mechanism 36 from debris and fluid ingress that may otherwise deteriorate the compliance mechanism 36, reduce performance, and eventually result in failure. Moreover, the contained nature of the compliance mechanism 36 may provide for easy cleaning of the pump assembly 10. Further, the roller and compliance assemblies 20, 36 may be readily incorporated into a peristaltic pump 10 in order to vary the number of rollers included in the pump 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A peristaltic pump for use with tubing, the pump comprising:

a raceway;

a rotatably mounted rotor;

a passageway formed between the raceway and the rotor, the passageway being adapted to receive said tubing;

a plurality of roller assemblies pivotably and eccentrically mounted to the rotor, each roller assembly having a length, and including a roller having an outer surface disposed to selectively roll along said tubing when received in the passageway; and at least one compliance mechanism coupled to each roller assembly, the compliance mechanism having first and second ends coupled to the rotor and the roller assembly, respectively, the compliance mechanism being adapted and disposed to bias the associated roller assembly outward relative to the rotor;

wherein substantially the majority of the compliance mechanism is contained within the length of the roller assembly and within inside of the roller.

2. The peristaltic pump of claim 1, wherein the compliance mechanism includes at least one spring.

3. The peristaltic pump of claim 2, wherein the compliance mechanism includes at least one of a torsion spring, a tension spring, and a compression spring.

4. The peristaltic pump of claim 1, wherein the compliance mechanism includes a torsion spring, the torsion spring includes a hub and first and second arms, the first arm being coupled to the rotor and the second arm being coupled to the roller assembly.

5. The peristaltic pump of claim 4, wherein the roller assembly pivots about a pivot axis, the hub being disposed along said pivot axis.

6. The peristaltic pump of claim 1, wherein the roller assembly includes a substantially cylindrical roller and a shaft, the roller being mounted to rotate about the shaft, the shaft being mounted eccentrically pivot about a pivot axis, the pivot axis being fixed relative to the shaft and the rotor.

7. The peristaltic pump of claim 6, wherein the compliance mechanism includes a torsion spring, the torsion spring includes a hub and first and second arms, the first arm being coupled to the rotor and the second arm being coupled to the roller assembly.

8. The peristaltic pump of claim 7, wherein the hub is disposed along the pivot axis.

9. A biased roller assembly for coupling to a peristaltic pump for use with tubing, the roller assembly comprising:

a length;

a substantially cylindrical roller having an interior;

a shaft having an outer annular surface, opposing shaft ends, and a central axis, the roller being rotatably disposed about said shaft, at least one of the shaft ends including at least one recess for receiving at least one post element defining a pivot axis, the pivot axis extending substantially parallel to, but not coaxially with, the central axis, the shaft being adapted to be coupled to the pump along said pivot axis; and at least one compliance mechanism having first and second ends, the first end being coupled to the at least one of the shaft ends, the second end being disposed to be coupled to the pump, the compliance mechanism being adapted to bias the shaft when mounted to the pump;

wherein substantially the majority of the compliance mechanism is contained inside of the roller assembly.

10. The roller assembly of claim 9, wherein the shaft includes a recess in each of the opposing shaft ends, the recesses extending through the pivot axis.

11. The roller assembly of claim 10 further comprising a pair of post elements extending from the recesses along the pivot axis.

12. The roller assembly of claim 9, wherein the recess includes a bore extending at least partially through the shaft along the pivot axis.

13. The roller assembly of claim 12 further including a pin extending through the bore.

14. The roller assembly of claim 9, wherein the roller has a length, the length of the roller coinciding with the length of the roller assembly.

15. The roller assembly of claim 9, wherein the compliance mechanism includes at least one spring.

16. The roller assembly of claim 9 further comprising at least one bearing assembly disposed between the roller and the shaft.

17. The roller assembly of claim 9, wherein the compliance mechanism includes a torsion spring, the torsion spring includes a huh and first and second arms, the first arm being coupled to the rotor and the second arm being coupled to the roller assembly.

18. The roller assembly of claim 17, wherein the hub is disposed along the pivot axis.

19. A dialysis machine including a peristaltic pump for use with tubing, the pump comprising:

a raceway;

a rotatably mounted rotor;

a passageway formed between the raceway and the rotor, the passageway being adapted to receive said tubing;

a plurality of roller assemblies pivotably mounted to the rotor, at least one of the roller assemblies having a length, a substantially cylindrical roller having an interior, and an outer surface disposed to selectively roll along said tubing when received in the passageway, a shaft, the roller being mounted to rotate about the shaft, the shaft being mounted to eccentrically pivot about a pivot axis, the pivot axis being fixed relative to the shaft and the rotor; and at least one compliance mechanism coupled to the at least one roller assembly, the compliance mechanism including at least one torsion spring having first and second ends coupled to the rotor and the roller assembly, respectively, the compliance mechanism being adapted and disposed to bias the associated roller assembly outward relative to the rotor, a force applied to the roller assembly pivoting the roller assembly inward against the force of the compliance mechanism, wherein the compliance mechanism is contained at least partially inside of the roller.

20. The dialysis machine of claim 19 further comprising at least one post element disposed along the pivot axis and extending outward from the shaft, the post element coupling the shaft to the rotor, the torsion spring further including a hub disposed along the pivot axis.

* * * * *